US008224193B2

(12) United States Patent
Yamada

(10) Patent No.: US 8,224,193 B2
(45) **Date of Patent: *Jul. 17, 2012**

(54) IMAGE FORMING APPARATUS, MFP AND METHOD OF DISPLAYING JAM REMOVAL GUIDANCE

(75) Inventor: Ayako Yamada, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 206 days.

This patent is subject to a terminal disclaimer.

(21) Appl. No.: 12/750,594

(22) Filed: Mar. 30, 2010

(65) Prior Publication Data

US 2010/0183320 A1 Jul. 22, 2010

Related U.S. Application Data

(63) Continuation of application No. 12/142,686, filed on Jun. 19, 2008, now Pat. No. 8,121,497, which is a continuation of application No. 11/365,329, filed on Feb. 28, 2006, now Pat. No. 7,403,721.

(51) Int. Cl.
*G03G 15/00* (2006.01)

(52) U.S. Cl. ..... 399/21; 399/9; 399/16; 399/23

(58) Field of Classification Search ..... 399/9, 16, 399/21, 23

See application file for complete search history.

(56) References Cited

U.S. PATENT DOCUMENTS

| | | | | |
|---|---|---|---|---|
| 5,602,625 | A | 2/1997 | Okamoto | |
| 7,403,721 | B2 | 7/2008 | Yamada | |
| 2003/0123886 | A1 | 7/2003 | Krolczyk | |
| 2004/0022548 | A1* | 2/2004 | Nagaoka | 399/16 |

FOREIGN PATENT DOCUMENTS

| | | |
|---|---|---|
| JP | 61-16309 | 1/1986 |
| JP | 06-138740 | 5/1994 |
| JP | 10-107940 | 4/1998 |
| JP | 11-231729 | 8/1999 |
| JP | 2005-156908 A | 6/2005 |

* cited by examiner

*Primary Examiner* — Matthew G Marini
*Assistant Examiner* — Andy Pham
(74) *Attorney, Agent, or Firm* — SoCal IP Law Group LLP; Steven C. Sereboff; John E. Gunther

(57) ABSTRACT

An image forming apparatus may include a printer to fix images on paper sheets that travel along a first paper path and a second paper path, and first and second doors that may be open to uncover the first and second paper paths, respectively. First and second sensors may detect if the respective doors are open and first and second jam detectors may detect jams along the respective paper paths. A memory may store first and second jam removal guidance for the jams along the respective paper paths. A controller may cause a display to switch from displaying the first jam removal guidance read from the memory to displaying the second jam removal guidance read from the memory upon the second door sensor detecting the second door is open.

20 Claims, 11 Drawing Sheets

IMAGE FORMING APPARATUS, MFP AND METHOD OF DISPLAYING JAM REMOVAL GUIDANCE

RELATED APPLICATION INFORMATION

This patent is a continuation of patent application Ser. No. 12/142,686, entitled "Image Forming Apparatus, MFP, and Method of Displaying Jam Removal Guidance", filed Jun. 19, 2008, now U.S. Pat. No. 8,121,497 B2, which is a continuation of patent application Ser. No. 11/365,329, entitled "Image Forming Apparatus, MFP, and Method of Displaying Jam Removal Guidance", filed Feb. 28, 2006, now U.S. Pat. No. 7,403,721 B2.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

The present invention relates to image forming apparatus such as facsimile machines, laser printers, copiers, inkjet printers, and combinations of those machines, MFPs (Multi-Function Peripherals), and a method of displaying jam removal guidance. In particular, the invention relates to an image forming apparatus and an MFP which display guidance for steps of operations such as jam processing, toner replenishment, and ink replacement and to a method of displaying jam removal guidance.

2. Description of the Related Art

When a jam occurs in an image forming apparatus according to the related art, a detector provided in the image forming apparatus detects the position of the occurrence of the jam, and guidance for operational steps for removing the jam can be displayed.

For example, Japanese Patent Laid-Open "JP-A-61-16309" (Patent Document 1) discloses an image forming apparatus capable of displaying the contents of jam removal guidance according to an output of a detector provided in the image forming apparatus.

For example, Japanese Patent Laid-Open "JP-A-6-138740" (Patent Document 2) discloses am image forming apparatus capable of displaying two displaying screens on a touch panel display provided at the image forming apparatus, the screens being a screen displaying a schematic view of the entire apparatus and a jam mark indicating the occurrence of a jam in the position where the jam has occurred and a screen displaying the contents of guidance for removing the jam.

For example, Japanese Patent Laid-Open "JP-A-10-107940" (Patent Document 3) discloses an image forming apparatus capable of displaying guidance for operational steps for removing a jam on a display of the image forming apparatus, when the user performs an input operation from an input/output portion of the image forming apparatus or when a self diagnosis function provided in the image forming apparatus is activated at the time of the occurrence of the jam. The image forming apparatus disclosed in Patent Document 3 is capable of displaying guidance in accordance with a position where a jam has not been removed by making an addition or deletion to or from the contents of guidance displayed on the display based on the progress of jam removal determined from an output of a detector.

For example, Japanese Patent Laid-Open "JP-A-11-231729" (Patent Document 4) discloses an image forming apparatus which allows a user to recognize the position of a remaining jam by making a change in a display of a schematic view of the entire apparatus such as turning off a jam mark associated with each position where a jam has been removed.

In the above-described image forming apparatus, however, when a user (operator) does not execute a process according to displayed guidance and performs a jam removal operation according to a different procedure, guidance after the execution is not in accordance with the state of the apparatus, which has resulted in a problem in that the user is confused.

SUMMARY OF THE INVENTION

The invention has been made taking the above-described situation into consideration, and it is an object of the invention to provide an image forming apparatus, an MFP (Multi-Function Peripheral), and a method of displaying jam removal guidance, in which display guidance in accordance with the state of the apparatus is displayed after the execution of a jam removal operation even when the user (operator) has not performed the operation according to displayed guidance.

In order to achieve the above-described object, an image forming apparatus and an MFP according to the invention comprise a scanner configured to read an image, a printer configured to fix an image formed thereby on paper and to discharge the paper, a display configured to display information, and a controller configured to control the scanner, the printer, and the display. The controller is configured to execute control such that jam removal guidance in accordance with an operation of a user is displayed on the display in case that the operation of the user in an attempt to remove a jam that has occurred in the printer is different from an order (sequence) displayed on the display.

A method of displaying jam removal guidance according to the invention comprises displaying predetermined guidance which is set in advance, identifying an interrupt requester where there is a request for an interrupt and determining the contents of display of jam removal guidance associated with the requester, and displaying the contents of the jam removal guidance determined at the jam removal guidance display contents determination step.

According to the invention, even when a user (operator) has not executed a jam removal operation according to displayed guidance, guidance adapted to the state of the apparatus after the execution is displayed, which allows the user to execute a jam removal operation without confusion.

DETAILED DESCRIPTION

Description of Apparatus

Embodiments of an image forming apparatus, an MFP, and a method of displaying jam removal guidance according to the invention will now be described with reference to the accompanying drawings.

It should be noted that upward, downward, leftward, rightward directions and forward and backward directions in the specification are used with reference to a normal usage state of an apparatus unless otherwise specified.

Figure 1:
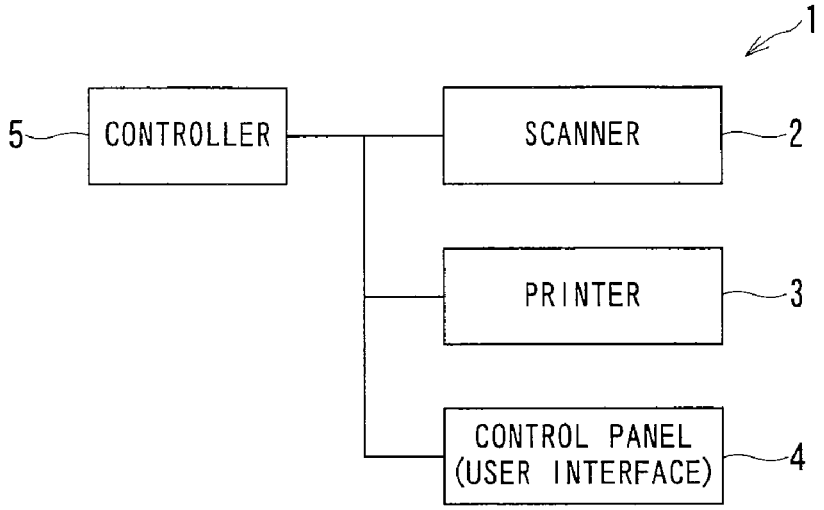
FIG. 1 is a schematic illustration of a functional configuration of an image forming apparatus 1 which is an example of an image forming apparatus according to the invention.

FIG. 1 is a schematic illustration of a functional configuration of an image forming apparatus 1 that is an example of an image forming apparatus according to the invention.

The image forming apparatus 1 includes a scanner 2 configured to read an image, a printer 3 configured to fix the image on paper and to discharge the paper, a control panel 4 as an input device and an output device serving as an interface with a user, and a controller 5 configured to control the scanner 2, the printer 3, and the control panel 4.

A network connection device, an automatic document feeder, and a relaying device (see FIG. 2), etc. may be connected to the image forming apparatus 1 as occasion demands.

Figure 2:
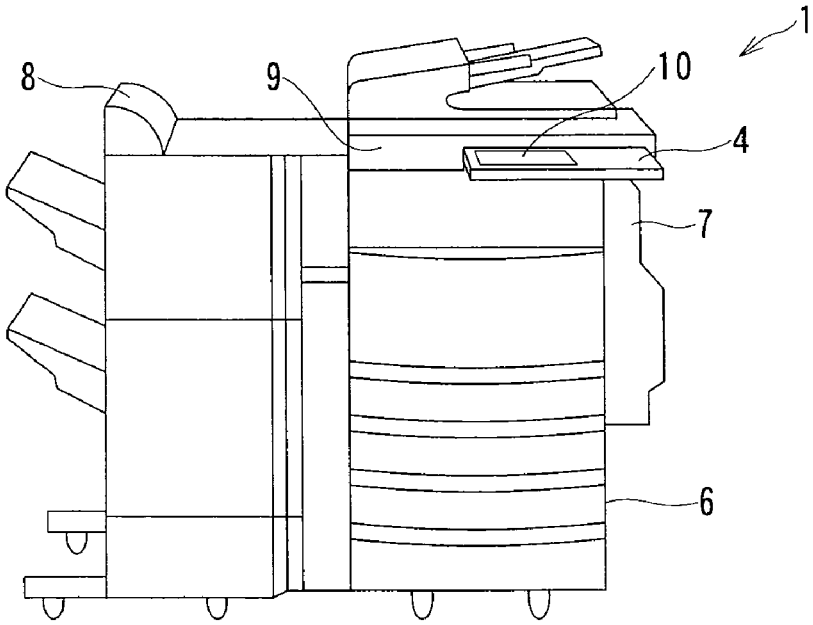
FIG. 2 schematically shows the general appearance of the example of an image forming apparatus according to the invention.

FIG. 2 schematically shows the appearance of the image forming apparatus 1.

The image forming apparatus 1 shown in FIG. 2 includes a sheet feeder 6 as to supply paper, a fixing device 7 having a fixing unit configured to fix an image on a surface of paper, the control panel 4, a finisher 8 as to receive paper having an image fixed thereon and to discharge the paper, and a relaying device 9 transferring paper from the fixing device 7 to the finisher 8.

For example, the control panel 4 includes a touch panel display 10 and serves as an interface with a user. More specifically, touch panel display 10 provides information to a user and accepts input operations of a user.

The relaying device 9 is a device provided when the finisher 8 is provided, and it conveys paper from the fixing device 7 to the finisher 8.

In the image forming apparatus 1, the fixing device 7 fixes an image on paper supplied from the sheet feeder 6. The paper having an image fixed thereon is conveyed from the fixing device 7 to the finisher 8 via the relaying device 9. The paper conveying path (between the sheet feeder 6 and the finisher 8) may be clogged (jammed) with the paper when the image is fixed and the paper is discharged.

It is not essential for the image forming apparatus 1 to have the finisher 8. In this case, paper is directly discharged from the fixing device 7. The relaying device 9 is a device which is provided when the finisher 8 is provided, and it is not provided when the finisher 8 is not provided.

Figure 3:
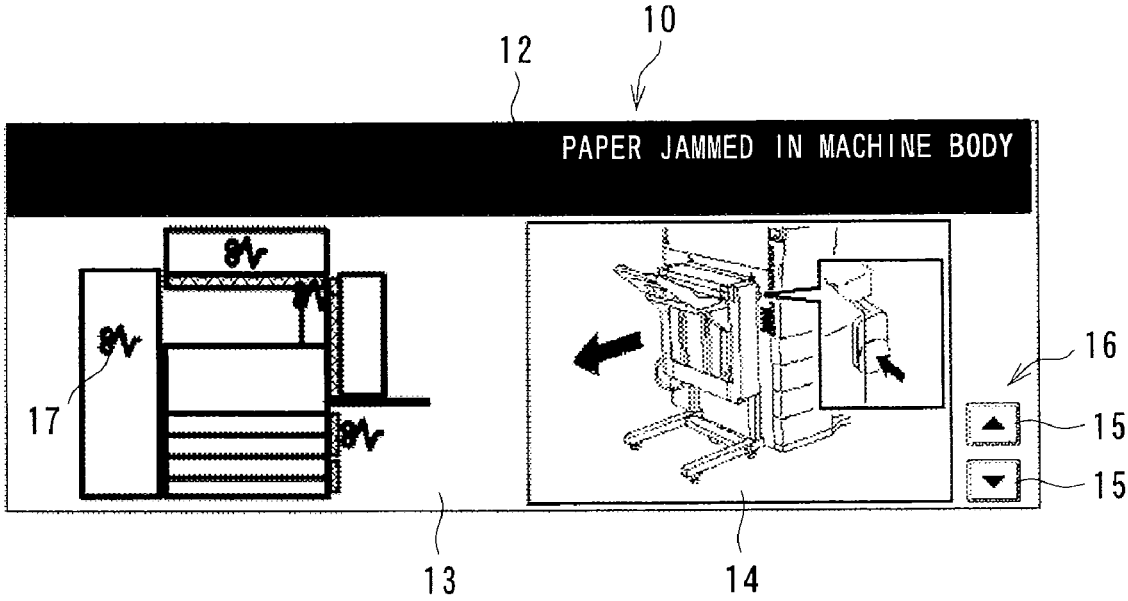
FIG. 3 shows an example of a screen displayed on a touch panel display when jams occur in the image forming apparatus according to the invention.

FIG. 3 shows an example of a screen displayed on the touch panel display 10 when a jam occurs in the image forming apparatus 1.

The touch panel display 10 has a region 12 for displaying the occurrence of a jam (hereinafter referred to as an apparatus status notifying region), a region 13 for schematically displaying the apparatus as a whole and displaying a position where a jam has occurred (hereinafter referred to as a jam position notifying region), a region 14 for displaying guidance for removing a jam (hereinafter referred to as jam removal guidance), the region hereinafter being referred to as a jam removal guidance display region, and an operation button region 16 for displaying operation buttons 15 configured to change (advance or reverse) the jam removal guidance displayed in the jam removal guidance display region. The reference numeral 17 represents a jam mark which is a symbol indicating the occurrence of a jam.

A control system of the image forming apparatus 1 will now be described.

Figure 4:
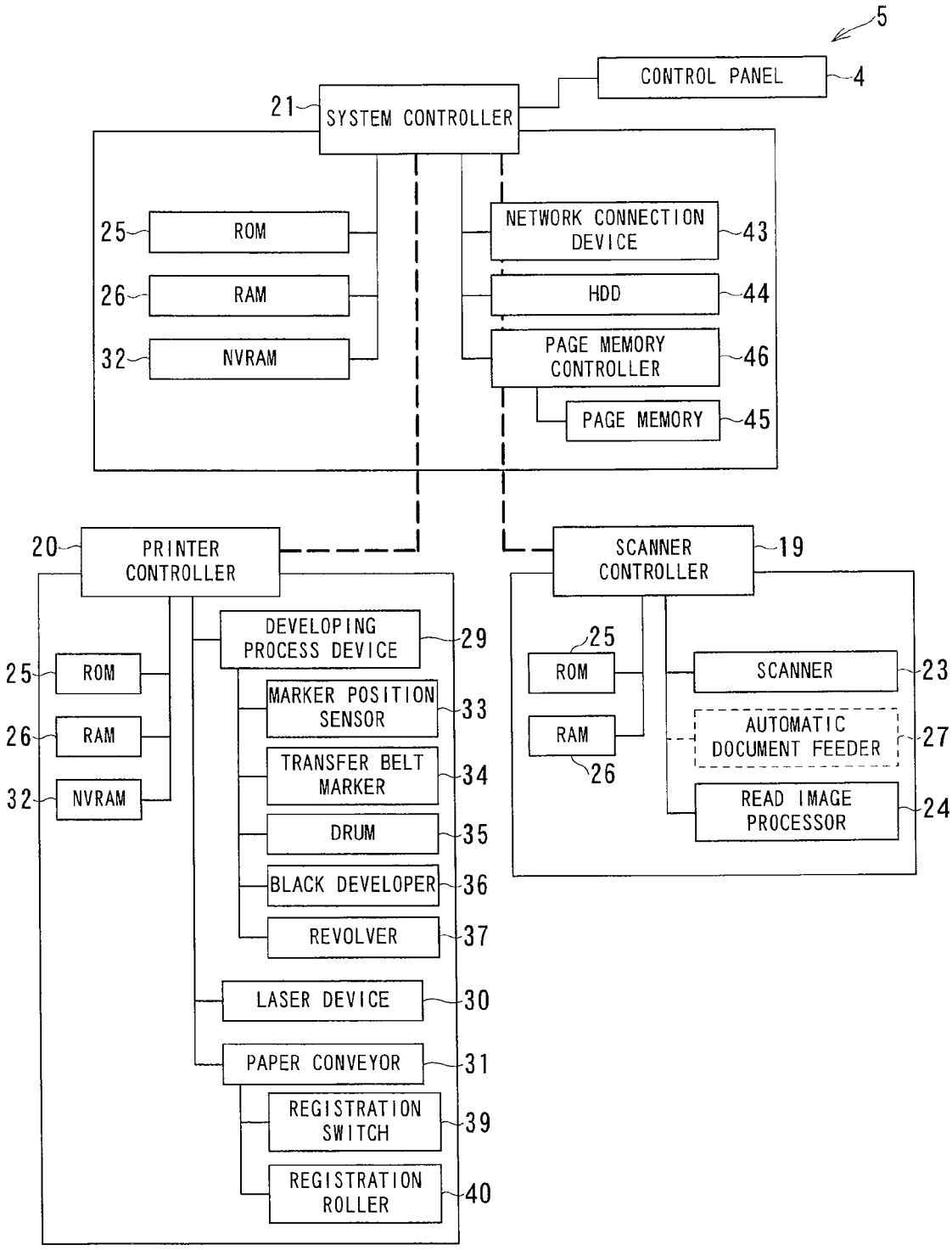
FIG. 4 is a diagram for explaining a configuration of a controller and objects of control in the image forming apparatus according to the invention.

FIG. 4 is a diagram for explaining an exemplary configuration of the controller 5 and a control system thereof which are preferable for the image forming apparatus 1.

The controller 5 includes a scanner controller 19 configured to control the scanner 2, a printer controller 20 configured to control the printer 3, and a system controller 21 configured to control image formation as a whole.

The scanner controller 19 controls a scanner 23 configured to read an image described on an original, a read image processor 24 configured to process the read image, and a ROM (Read Only Memory) 25 and a RAM (Random Access Memory) 26 as storages configured to store information required for executing a scanning process.

When the image forming apparatus 1 is provided with an automatic document feeder 27 configured automatically to feed an original from which an image is to be read, there are provided the ROM 25, RAM 26, and an NVRAM (Nonvolatile Video Random Access Memory) 32 as storages configured to store information required for executing an image forming process.

A developing process device 29 includes a marker position sensor 33, a transfer belt 34, a drum 35, a black developer 36, and a revolver 37 to execute processes in accordance with image formation and image fixing.

A sheet conveyer 31 includes a registration switch 39 for detecting whether there is a jam or not during conveyance of a sheet and a registration roller 40 configured to convey a sheet, and it conveys a sheet on which an image is to be fixed from the sheet feeder 6 to the finisher 8 shown in FIG. 1.

The system controller 21 includes a network connection device 43 as a communication interface responsible for establishing electrical connection to an external apparatus, which is not shown, through a communication network to allow mutual exchange of information with the apparatus, an HDD (Hard Disk Drive) 44 configured to record and store information, a page memory controller 46 configured to control a page memory 45, and the ROM 25, RAM 26, and the NVRAM 32 as storages configured to store information required to control image formation as a whole.

When a jam occurs in the image forming apparatus 1 according to the invention configured as thus described, the controller 5 causes the touch panel display 10 to display the occurrence of a jam, the position where the jam has occurred, and guidance for jam removal, for example, as shown in FIG. 2 based on information from a sensor which has detected the jam.

Figure 5:
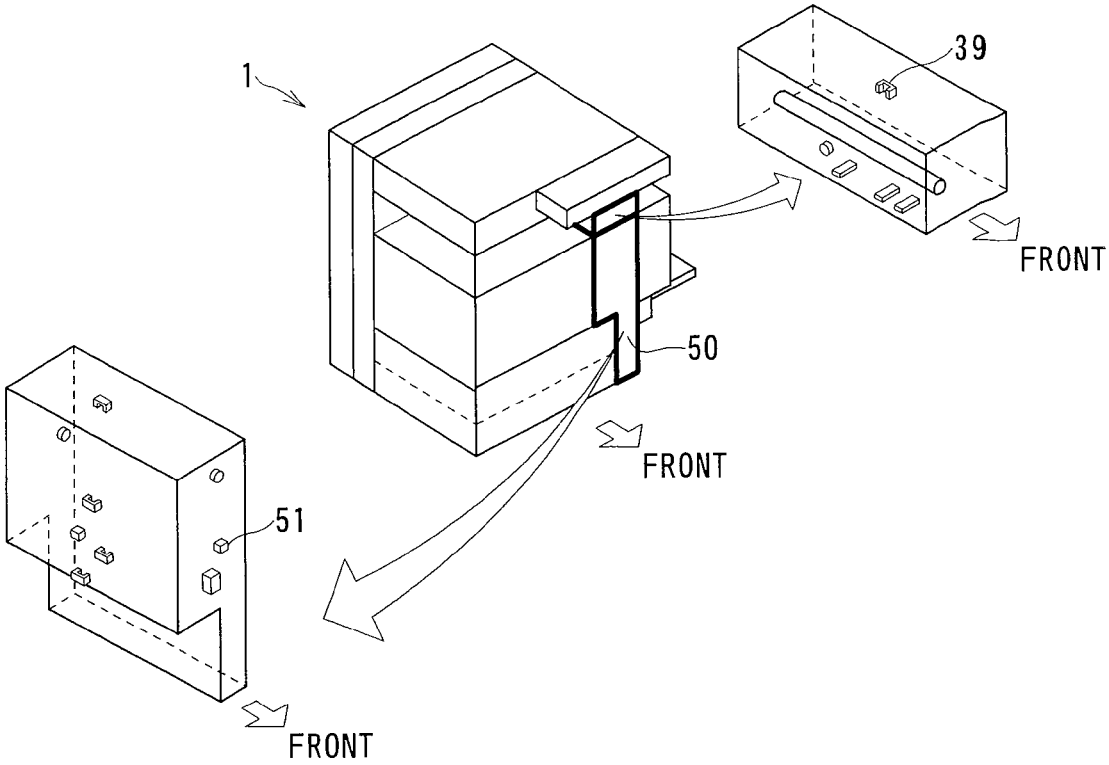
FIG. 5 shows an example of a display on the touch panel display presented when jams occur in the image forming apparatus according to the invention to leave sheets remaining (clogged) at a sheet feeder, a fixing device, a finisher, and a relaying device.

FIG. 5 is an illustration for explaining how detection is performed to see whether there is a jam at the fixing device 7 that is an example of a location of the image forming apparatus 1 where a jam can occur and whether a user is executing a jam removal operation.

In order to remove a jam in the fixing device 7, the user must open a fixing device door 50. In the image forming apparatus 1, an open/close sensor 51 configured to detect open and closed states of the fixing device door 50 is provided, and it is detected that the user is executing an operation of removing a jam at the fixing device 7 if the fixing device door 50 is open when there is a jam.

The registration switch 39 configured to detect the presence of a jam is provided in a paper conveying path of the fixing device 7. When the registration switch 39 detects a jam, information indicating the detection of a jam is sent to the controller 5, and the occurrence of a jam at the fixing device 7 is displayed in the jam position notifying region 13 of the touch panel display 10.

While FIG. 5 shows the fixing device 7, the description applies also to the sheet feeder 6, the finisher 8, and the relaying device 9. Specifically, similar sensors 51 and 52 are also provided at the sheet feeder 6, the finisher 8, and the relaying device 9, and the controller 5 can detect whether there is a jam or not and whether the user is executing a jam removal operation at each of the sheet feeder 6, the finisher 8, and the relaying device 9.

Figure 6:
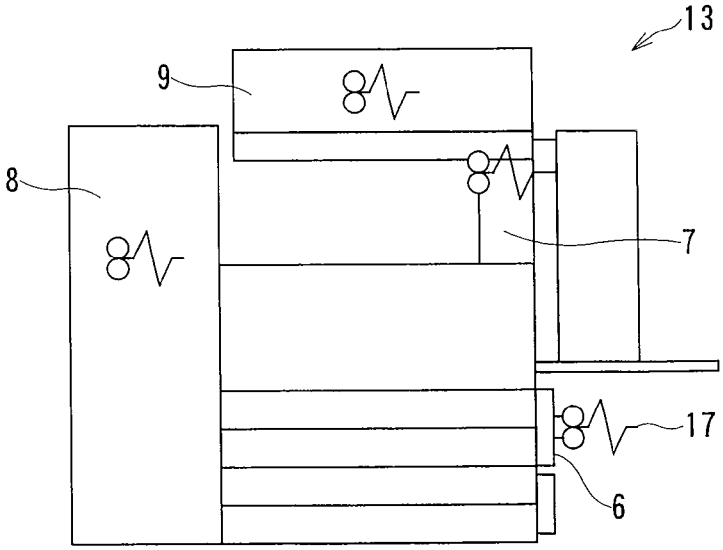
FIG. 6 shows an example of a display on the touch panel display presented when jams occur in the image forming apparatus according to the invention to leave sheets remaining (clogged) at the sheet feeder, the fixing device, the finisher, and the relaying device.

FIG. 6 shows an example in which it is displayed in the jam position notifying region 13 of the touch panel display 10 that jams have occurred and that paper remains at (clogs) the sheet feeder 6, the fixing device 7, the finisher 8, and the relaying device 9.

A method of displaying jam removal guidance according to the invention will now be described with reference to the situation in which jams have occurred as shown in FIG. 6 by way of example.

According to the method of displaying jam removal guidance of the invention, when a user removes a jam according to jam removal guidance (FIGS. 7 to 10 to be described later) which has been set in advance, the preset jam removal guidance is displayed. When the user does not remove the jam according to the predetermined jam removal guidance which has been set in advance, jam removal guidance is displayed in accordance with the jam removal operation the user has executed.

FIGS. 7 to 10 show jam removal guidance displayed in the jam removal guidance display region 14 of the touch panel display 10 when jams have occurred.

Figure 7:
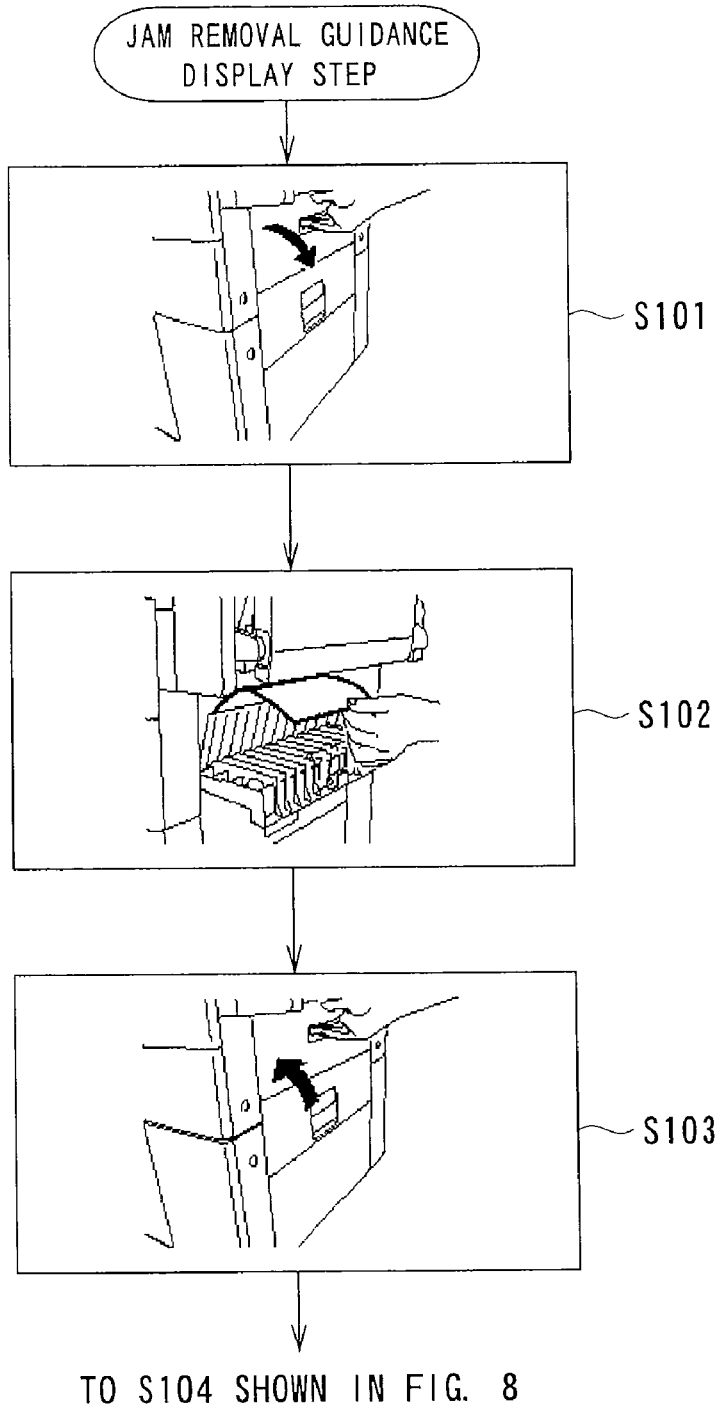
FIG. 7 shows an example of jam removal guidance for the sheet feeder displayed on the image forming apparatus according to the invention.
Figure 8:
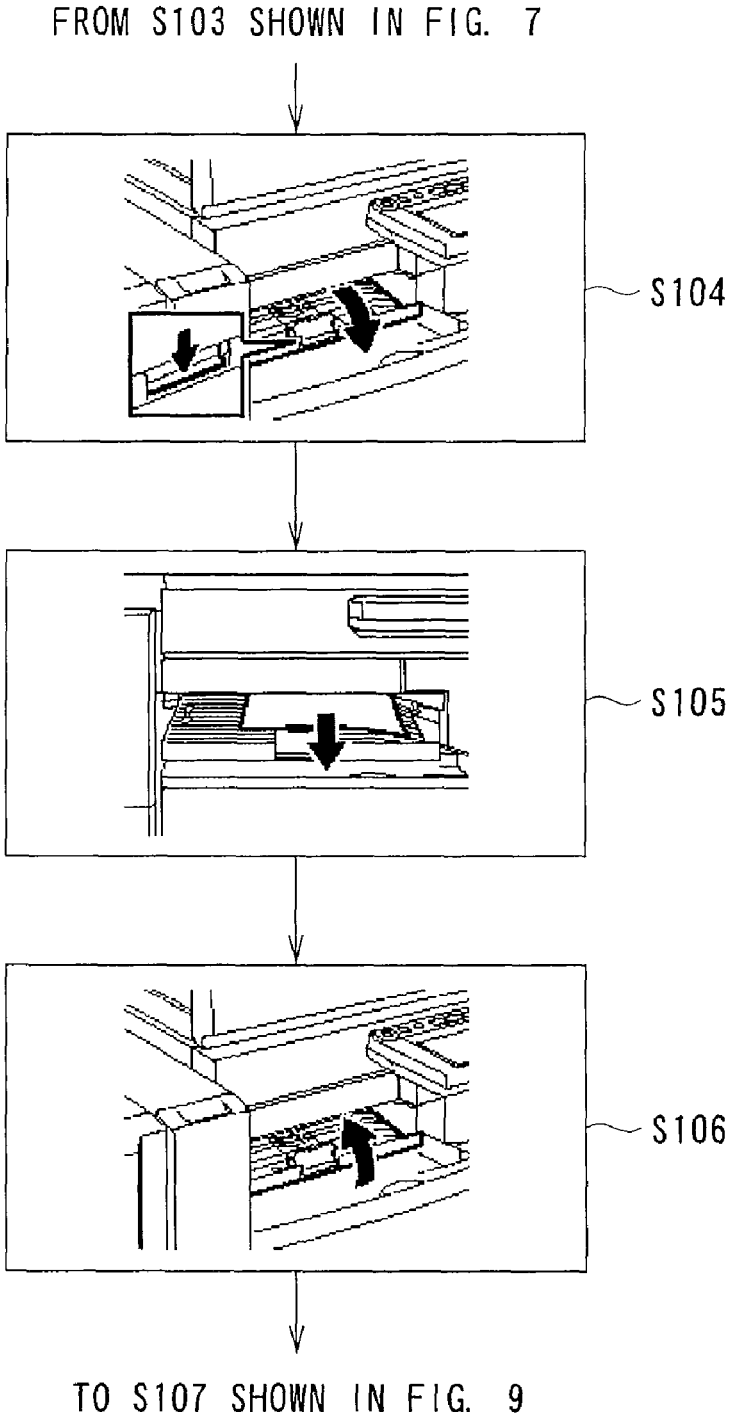
FIG. 8 shows an example of jam removal guidance for the relaying device displayed on the image forming apparatus according to the invention.
Figure 9:
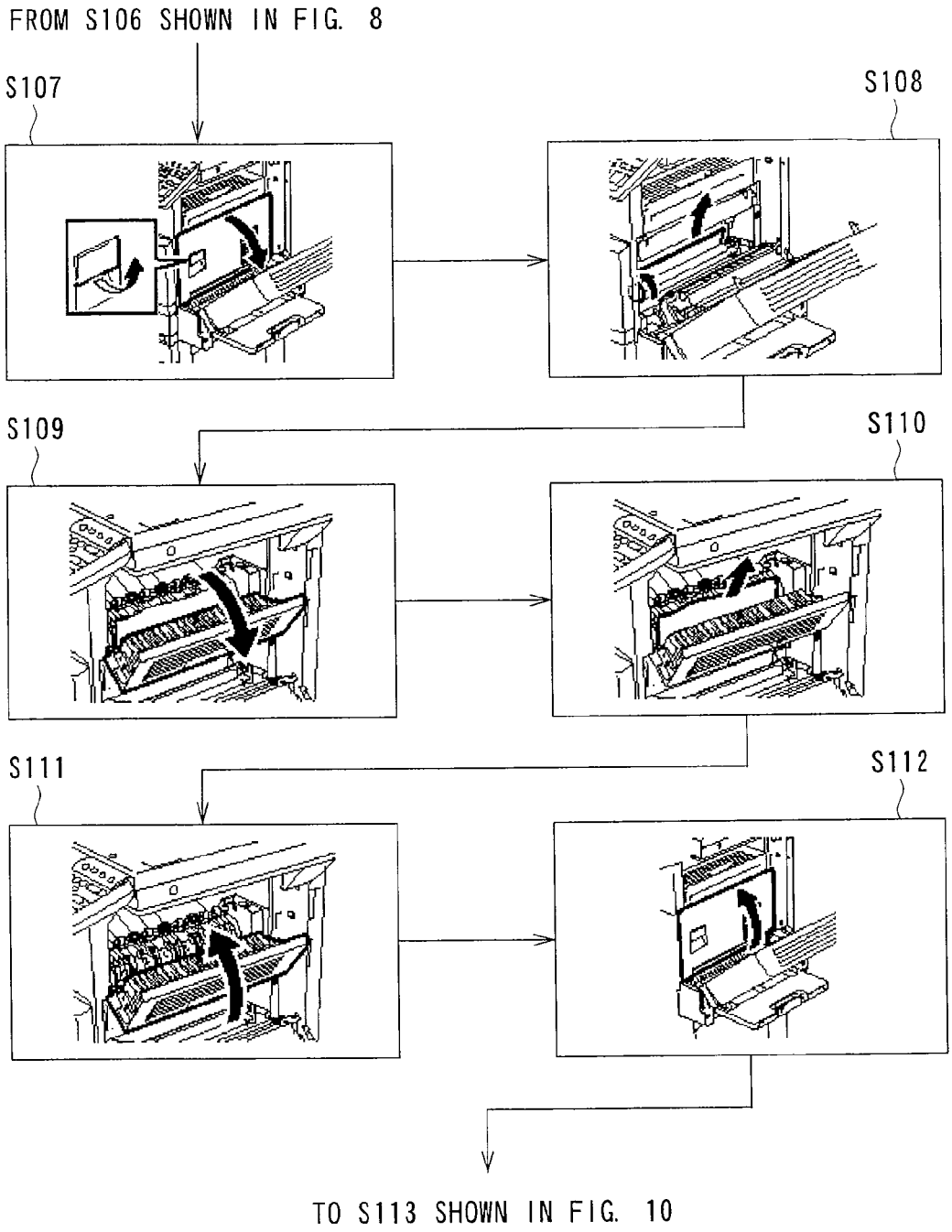
FIG. 9 shows an example of jam removal guidance for the fixing device displayed on the image forming apparatus according to the invention.
Figure 10:
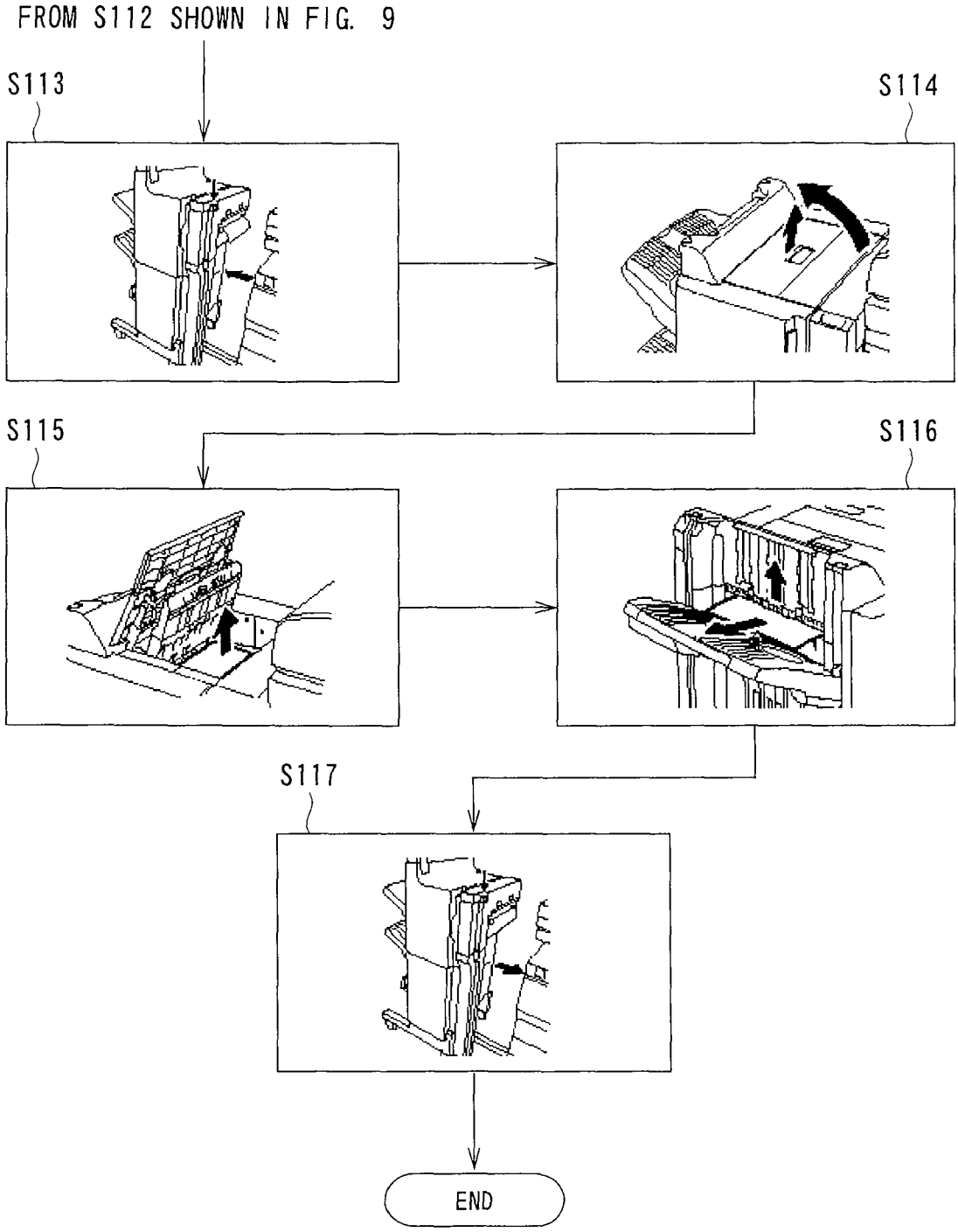
FIG. 10 shows an example of jam removal guidance for the finisher displayed on the image forming apparatus according to the invention.

Specifically, FIG. 7 shows jam removal guidance for the sheet feeder 6; FIG. 8 shows jam removal guidance for the relaying device 9; FIG. 9 shows jam removal guidance for the fixing device 7; and FIG. 10 shows jam removal guidance for the finisher 8.

For example, let us assume that when paper remains at (clogs) the sheet feeder 6, the fixing device 7, the finisher 8, and the relaying device 9 as shown in FIG. 6, the jams are removed at the sheet feeder 6, the relaying device 9, the fixing device 7, and then the finisher 8 according a preset order for jam removal. Then, jam removal guidance obtained by arranging the pieces of jam removal guidance shown in FIGS. 7, 8, 9, and 10 in the order listed is displayed in the jam removal guidance display region 14 as predetermined guidance.

Figure 11:
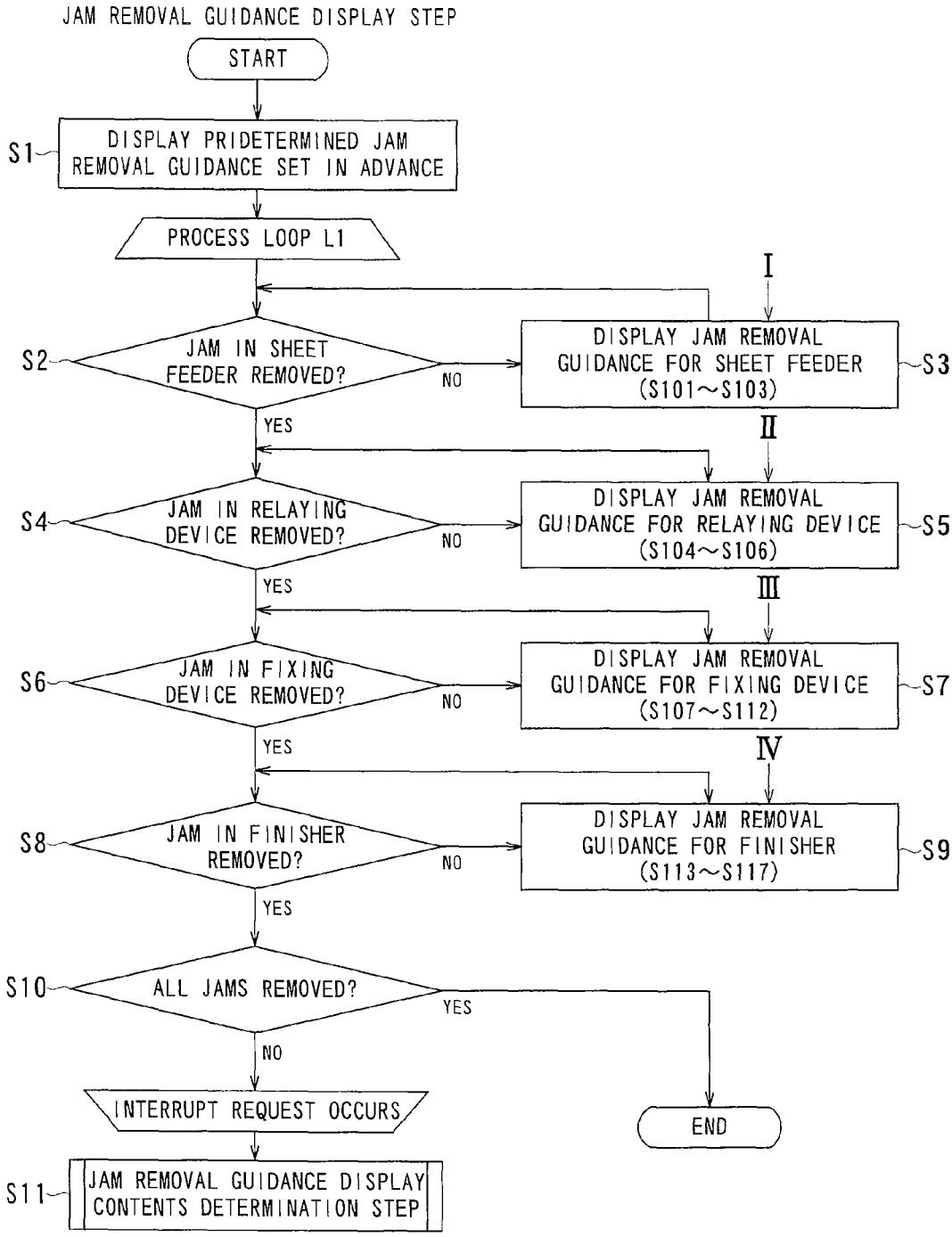
FIG. 11 is a flow chart showing a method of displaying jam removal guidance according to the invention.

FIG. 11 is a flow chart showing jam removal guidance display steps constituting the method of displaying jam removal guidance according to the invention.

The jam removal guidance displaying steps include a predetermined jam removal guidance display step (step S1) for displaying predetermined guidance which is set in advance, a jam removal guidance display contents determination step (step S11) for identifying a requester of an interrupt when there is a request for an interrupt and determining the contents of display of guidance for removing a jam (hereinafter referred to as jam removal guidance) associated with the requester, a jam removal guidance display step (step S3, step S5, step S7, and step S9 shown in FIG. 11 and step S36, step S39, step S42, and step S45 shown in FIG. 14 to be described later) for displaying the contents of the jam removal guidance determined at the jam removal guidance display contents determination step.

When the controller 5 detects the occurrence of jams, the process at the jam removal guidance display step is started (START). First, the predetermined jam removal guidance display step is executed (step S1).

At the predetermined jam removal guidance display step, a first page of the predetermined jam removal guidance (a page corresponding to S101 shown in FIG. 6 in the present embodiment) is displayed in the jam removal guidance display region 14 of the touch panel display 10. Subsequently, the process enters a process loop L1 in which process steps from step S2 to step S11 are executed until a request for an interrupt is made (a condition for exiting the process loop L1) or until all jams which have occurred are removed (until the answer at step S10 is YES).

When the process loop L1 is entered, the controller 5 first executes a jam removal operation completion check step (see FIG. 12 to be described later for details) at step S2 to check whether the jam which occurred at the sheet feeder 6 has been removed.

When the jam which occurred at the sheet feeder 6 has not been removed yet (the answer at step S2 is NO), the controller 5 executes a sheet feeder jam removal guidance display step to display pieces of guidance for removing the jam at the sheet feeder 6 sequentially at step S3. Specifically, the jam removal guidance is displayed in the order shown in FIG. 7 in the jam removal guidance display region 14 of the touch panel display 10.

After display at sheet feeder jam removal guidance display steps (S101 to S103 shown in FIG. 7) is completed, the controller 5 returns to step S2 to check whether the jam which occurred at the sheet feeder 6 has been removed. When the jam has been removed (the answer at step S2 is YES), the process proceeds to step S4.

At step S4, the controller 5 executes a jam removal operation completion check step to check whether the jam which occurred at the relaying device 9 has been removed. When the jam which occurred at the relaying device 9 has not been removed yet (the answer at step S4 is NO), the controller 5 executes a relaying device jam removal guidance display step to display pieces of guidance for removing the jam at the relaying device 9 sequentially at step S5. Specifically, the jam removal guidance is displayed in the order shown in FIG. 8 in the jam removal guidance display region 14 of the touch panel display 10.

After display at relaying device jam removal guidance display steps (S104 to S106 shown in FIG. 8) is completed, the controller 5 returns to step S4 and executes a jam removal operation completion check step to check whether the jam which occurred at the relaying device 9 has been removed. When the jam has been removed (the answer at step S4 is YES), the process proceeds to step S6.

At step S6, the controller 5 executes a jam removal operation completion check step to check whether the jam which occurred at the fixing device 7 has been removed. When the jam which occurred at the fixing device 7 has not been removed yet (the answer at step S6 is NO), the controller 5 executes a fixing device jam removal guidance display step to display pieces of guidance for removing the jam at the fixing device 7 sequentially at step S7. Specifically, the jam removal guidance is displayed in the order shown in FIG. 9 in the jam removal guidance display region 14 of the touch panel display 10.

After display at fixing device jam removal guidance display steps (S107 to S112 shown in FIG. 9) is completed, the controller 5 returns to step S6 to check whether the jam which occurred at the fixing device 7 has been removed. When the jam has been removed (the answer at step S6 is YES), the process proceeds to step S8.

At step S8, the controller 5 executes a jam removal operation completion check step to check whether the jam which occurred at the finisher 8 has been removed. When the jam which occurred at the finisher 8 has not been removed yet (the answer at step S8 is NO), the controller 5 executes a finisher jam removal guidance display step to display pieces of guidance for removing the jam at the finisher 8 sequentially at step S9. Specifically, the jam removal guidance is displayed in the order shown in FIG. 10 in the jam removal guidance display region 14 of the touch panel display 10.

After display at finisher jam removal guidance display steps (S113 to S117 shown in FIG. 10) is completed, the controller 5 returns to step S8 and executes a jam removal operation completion check step to check whether the jam which occurred at the finisher 8 has been removed. When the jam has been removed (the answer at step S8 is YES), the process proceeds to step S10.

At step S10, the controller 5 checks whether all jams have been removed. When all jams have been removed (the answer at step S10 is YES), the controller 5 exits the process loop L1 to proceed to END, and the jam removal guidance display step is thus completed (END).

When there is a request for an interrupt during the execution of any of the process steps of the process loop L1, the process exits the process loop L1 to proceed to step S11 at which a jam removal guidance display contents determination step (see FIG. 14 to be described later for details) is executed.

An interrupt request occurs when the user does not remove the jams according to the predetermined order of jam removal guidance. Specifically, it may be information indicating the fact that a door is open transmitted from the door which should not be open if the user is removing the jams according to the predetermined order of jam removal guidance. For example, when the fixing device door 50 is opened during the execution of the sheet feeder jam removal guidance display step (step S2), the controller 5 determines information indicating that the fixing device door 50 is open received from the open/close sensor 51 as an interrupt request.

When the jam removal guidance display contents determination step is executed, the process returns to the process loop L1 from any of "I", "II", "III", and "IV" shown in FIG. 11.

The process flow shown in FIG. 11 describes a case in which jams as shown in FIG. 6 occur, and process steps executed in other cases will be the process steps shown in FIG. 6 excluding location(s) having no jam.

Although the predetermined jam removal guidance was described as jam removal guidance which is a sequential arrangement of the pieces of jam removal guidance shown in FIGS. 7, 8, 9, and 10 by way of example, the jam removal guidance may be set in a different order.

Figure 12:
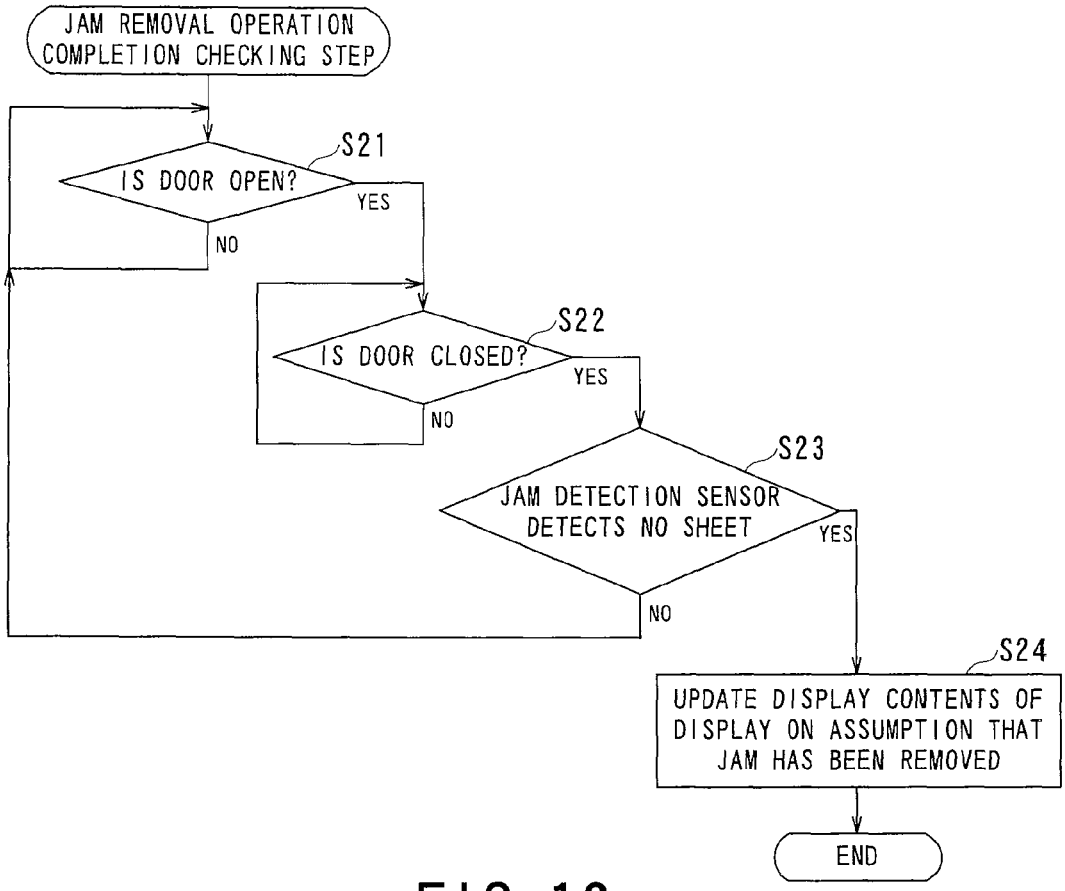
FIG. 12 is a flow chart showing detailed process steps of a jam removal operation completion check step of the method of displaying jam removal guidance according to the invention.

FIG. 12 is a flow chart showing detailed process steps of the jam removal operation completion check step shown in FIG. 11.

At the jam removal operation completion check step, it is first checked at step S21 whether the doors of the sheet feeder 6, the fixing device 7, and the relaying device 9 are open or whether the finisher 8 is disconnected.

When the doors of the sheet feeder 6, the fixing device 7, and the relaying device 9 are open or when the finisher 8 is disconnected (when the answer at step S21 is YES), the process proceeds to step S22 at which it is checked whether the doors of the sheet feeder 6, the fixing device 7, and the relaying device 9 are closed or whether the finisher 8 is connected.

When the doors of the sheet feeder 6, the fixing device 7, and the relaying device 9 are closed or when the finisher 8 is connected (the answer at step S22 is YES), the process proceeds to step S23 at which the registration switch 39 detects the presence of jams. When there is no jammed sheet or jams have been removed (the answer at step S23 is YES), the controller 5 receives information from the registration switch 39 indicating that there is no jammed sheet, updates the display in the jam position notifying region 13 of the touch panel display 10, and terminates the jam removal operation completion check step.

When the doors of the sheet feeder 6, the fixing device 7, and the relaying device 9 are closed or when the finisher 8 is connected at step S21 (the answer at step S21 is NO), the process step at step S21 is repeated until the doors of the sheet feeder 6, the fixing device 7, and the relaying device 9 are opened or until the finisher 8 is disconnected (until the answer at step S21 is YES).

When the doors of the sheet feeder 6, the fixing device 7, and the relaying device 9 are open or when the finisher 8 is disconnected at step S22 (the answer at step S22 is NO), the process step at step S22 is repeated until the doors of the sheet feeder 6, the fixing device 7, and the relaying device 9 are closed or until the finisher 8 is connected (until the answer at step S22 is YES).

When the detection of the presence of jams by the registration switch 39 at step S23 indicates that there is a jamming sheet or jams have not been removed yet (when the answer at step S23 is NO), the process returns to step S21 to execute process steps at step S21 and later.

Figure 13:
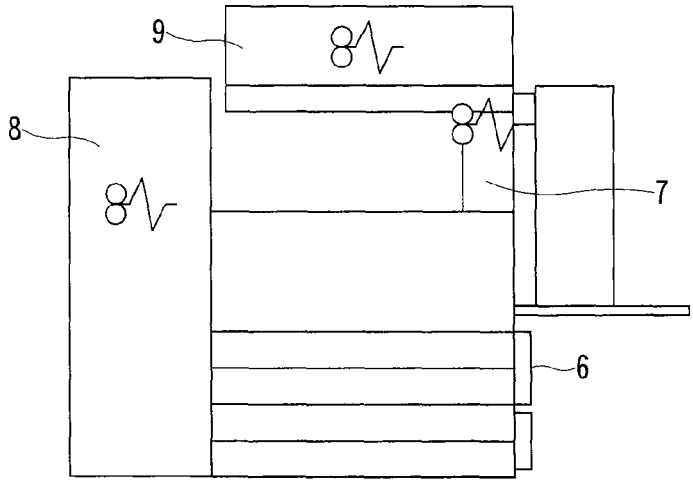
FIG. 13 shows display contents displayed in a jam position notifying region of a touch panel display when a jam at the sheet feeder has been removed from the state shown in FIG. 6 as a result of a jam removal operation of a user.

FIG. 13 shows display contents displayed in the jam position notifying region 13 of the touch panel display 10 when the jam at the sheet feeder 6 has been removed from the state shown in FIG. 6 as a result of a jam removal operation of the user.

A comparison between the states shown in FIGS. 6 and 13 indicates that a jam mark 17 at the sheet feeder 6 has disappeared, and the user can recognize that the jam at the sheet feeder 6 has been removed by looking at the display in the jam position notifying region 13 of the touch panel display 10.

Figure 14:
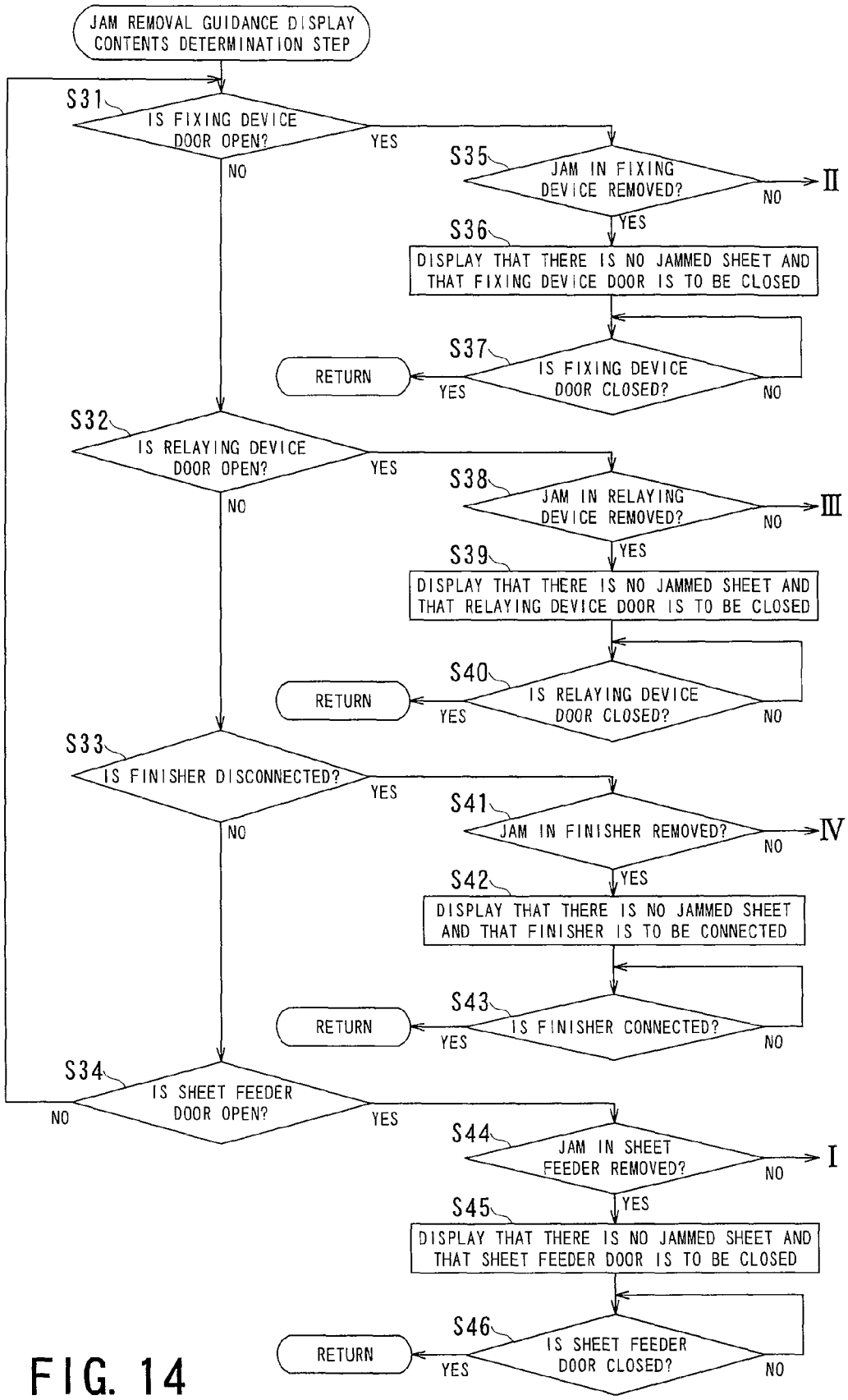
FIG. 14 is a flow chart showing detailed process steps of a jam removal guidance display contents determination step of the method of displaying jam removal guidance according to the invention.

FIG. 14 is a flow chart showing detailed process steps of the jam removal guidance display contents determination step shown in FIG. 11.

The jam removal guidance display contents determination step includes interrupt requester identifying steps (steps S31 to step S34) for identifying a requester (transmitter) of a request for an interrupt and interrupt requester jam removal detection steps (step S35, step S38, step S41, and step S44) for detecting whether a jam at the requester identified at the interrupt requester identifying steps has been removed.

At the jam removal guidance display contents determination step, the process first proceeds to step S31, and the interrupt requester identifying steps (step S31 to step S34) are executed at steps S31 to S34. Thus, the controller 5 detects the requester of an interrupt, i.e., the door which was opened or whether the finisher 8 was disconnected.

First, it is detected at step S31 whether the door of the relaying device 9 is open or not. If not (the answer at step S31 is NO), the process proceeds to step S32.

At step S32, it is detected whether the door of the fixing device 7 (the fixing device door 50) is open or not. If not (the answer at step S32 is NO), the process proceeds to step S33.

At step S33, it is detected whether the finisher 8 is disconnected or not. If not (the answer at step S33 is NO), the process proceeds to step S34.

At step S34, it is detected whether the door of the sheet feeder 6 is open or not. If not (the answer at step S34 is NO), the process returns to step S31.

When it is detected at step S31 that the door of the relaying device 9 is open (the answer at step S31 is YES), the controller 5 subsequently detects whether the jam at the relaying device 9 has been removed or not at step S35.

When the jam at the relaying device 9 has been removed (the answer at step S35 is YES), it is displayed in the apparatus status notifying region 12 of the touch panel display 10 that no sheet is jammed at the relaying device 9 and that it is requested to close the door of the relaying device 9 at step S36. When the controller 5 confirms that the door of the relaying device 9 has been closed (the answer at step S37 is YES), the process returns to the process step in the process loop L1 shown in FIG. 11 which was being executed when the interrupt request occurred.

When it is detected at step S32 that the door of the fixing device 7 (the fixing device door 50) is open (the answer at step S32 is YES), the controller 5 subsequently detects whether the jam at the fixing device 7 has been removed or not at step S38.

When the jam at the fixing device 7 has been removed (the answer at step S38 is YES), it is displayed in the apparatus status notifying region 12 of the touch panel display 10 that no sheet is jammed at the fixing device 7 and that it is requested to close the door of the fixing device door 50 at step S39. When the controller 5 confirms that the fixing device door 50 has been closed (the answer at step S40 is YES), the process returns to the process step in the process loop L1 shown in FIG. 11 which was being executed when the interrupt request occurred.

When it is detected at step S33 that the finisher 8 has been disconnected (the answer at step S33 is YES), the controller 5 subsequently detects whether the jam at the finisher 8 has been removed or not at step S41.

When the jam at the finisher 8 has been removed (the answer at step S41 is YES), it is displayed in the apparatus status notifying region 12 of the touch panel display 10 that no sheet is jammed at the finisher 8 and that it is requested to connect the finisher 8 at step S42. When the controller 5 confirms that the finisher 8 has been connected (the answer at step S43 is YES), the process returns to the process step in the process loop L1 shown in FIG. 11 which was being executed when the interrupt request occurred.

When it is detected at step S34 that the door of the sheet feeder 6 is open (the answer at step S34 is YES), the controller 5 subsequently detects whether the jam at the sheet feeder 6 has been removed or not at step S44.

When the jam at the sheet feeder 6 has been removed (the answer at step S44 is YES), it is displayed in the apparatus status notifying region 12 of the touch panel display 10 that no sheet is jammed at the sheet feeder 6 and that it is requested to close the door of the sheet feeder 6 at step S45. When the controller 5 confirms that the fixing device door 50 has been closed (the answer at step S46 is YES), the process returns to the process step in the process loop L1 shown in FIG. 11 which was being executed when the interrupt request occurred.

When the jam at the relaying device 9 has not been removed at step S35 (the answer at step S35 is NO), the process proceeds to "II" shown in FIG. 11.

When the jam at the fixing device 7 has not been removed at step S38 (the answer at step S38 is NO), the process proceeds to "III" shown in FIG. 11.

When the jam at the finisher 8 has not been removed at step S41 (the answer at step S41 is NO), the process proceeds to "IV" shown in FIG. 11.

When the jam at the sheet feeder 6 has not been removed at step S44 (the answer at step S44 is NO), the process proceeds to "I" shown in FIG. 11.

It has been described above that the apparatus status notifying region 12 of the touch panel display 10 displays that there is no jammed sheet and that it is requested to close the door at step S36, step S39, step S42, and step S45. Alternatively, the image forming apparatus 1 may be configured to have an audio output capability to notify the user that there is no jammed sheet and that it is requested to close the door using sounds instead of the display.

As thus described, in the image forming apparatus and the method of displaying jam removal guidance according to the invention, even when a user (operator) does not execute a jam removal operation according to displayed guidance, guidance in accordance with the state of the apparatus after the jam removal operation is displayed. The user can therefore execute a jam removal operation without confusion.

Although the invention has been described as an image forming apparatus in the above embodiment, the invention is applicable not only to image forming apparatus but also to MFPs (Multi-Function Peripherals).

Although the description has addressed a case in which jam removal guidance is graphics, at least one of characters and sounds may alternatively be used instead of graphics. Further, moving images may be used instead of graphics (still images).

Furthermore, the invention is not limited to the above-described embodiment as it is, and the invention may be embodied by making modifications to the constituent parts without departing from the spirit of the same when implemented.

It is claimed:

1. An image forming apparatus comprising:

a printer to fix images on paper sheets that travel along a first paper path and a second paper path;

a first door having an open state which uncovers the first paper path and a closed state;

a first door sensor to detect if the first door is open or closed;

a first jam detector to detect a first jam at the first paper path;

a second door having an open state which uncovers the second paper path and a closed state;

a second door sensor to detect if the second door is open or closed;

a second jam detector to detect a second jam at the second paper path;

a memory that stores a first jam removal guidance image for the first jam and a second jam removal guidance image for the second jam;

a display; and a controller that causes the display to switch from displaying the first jam removal guidance image read from the memory to displaying the second jam removal guidance image read from the memory upon the second door sensor detecting the second door is open.

2. The apparatus according to claim 1, further comprising a speaker configured to provide an audio output of information, wherein the jam removal guidance includes at least one of a sound, a character, a still image, and a moving image.

3. The apparatus according to claim 1, wherein the first jam removal guidance and the second jam removal guidance include at least one of characters and graphics.

4. The apparatus according to claim 1, wherein the controller causes the display to display a location where the jam occurs, as detected by the first jam detector and the second jam detector.

5. The apparatus according to claim 4, wherein the controller obtains an information of the location where the jam occurs, detected by the first jam detector and the second jam detector when at least one of open doors closes, and executes control to update displayed contents of the location where the jam occurs based on the obtained information.

6. The apparatus according to claim 4, wherein the controller executes control to update the displayed contents of the location where the jam removed when at least one of the first jam detector and the second jam detector detect the jam removal.

7. The apparatus according to claim 1, wherein the controller alternately switches between the first jam removal guidance and the second jam removal guidance based on a condition that the second door sensor detects whether the second door is open or closed.

8. A jam removal guidance device for an image forming apparatus comprising:

a memory having a first jam removal guidance image for a first jam which occurs at a first paper path in the image forming apparatus and a second jam removal guidance image for a second jam which occurs at a second paper path in the image forming apparatus;

a display displaying the first jam removal guidance and the second jam removal guidance read from the memory; and a controller configured to obtain a jam information from a jam detector which detects whether the first jam and the second jam occur, to obtain a first door open and closed information from a first door sensor detecting whether a first door covering and uncovering the first paper path, is open or closed, to obtain a second door open and closed information from a second door sensor detecting whether a second door covering and uncovering the second paper path, is open or closed, and to switch to display the second jam removal guidance from the first jam removal guidance on the display upon detecting the second door open by the second door sensor.

9. The apparatus according to claim 8, further comprising a speaker configured to provide an audio output of information, wherein the jam removal guidance includes at least one of a sound, a character, and either of a still image and a moving image.

10. The apparatus according to claim 8, wherein the first jam removal guidance and the second jam removal guidance include at least one of character and graphic.

11. The apparatus according to claim 8, wherein the controller executes control to display a location where a jam occurs, detected by the first jam detector and the second jam detector on the display.

12. The apparatus according to claim 11, wherein the controller obtains an information of the location where the jam occurs, detected by the first jam detector and the second jam detector when at least one of open doors closes, and executes control to update displayed contents of the location where the jam occurs based on the obtained information.

13. The apparatus according to claim 11, wherein the controller executes control to update the displayed contents of the location where the jam removed when at least one of the first jam detector and the second jam detector detect the jam removal.

14. The apparatus according to claim 8, wherein the controller alternatively switches between the first jam removal guidance and the second jam removal guidance based on a condition that the second door sensor detects whether the second door is open or closed.

15. A method of displaying jam removal guidance comprising:

detecting whether a first jam which occurs at a first paper path and a second jam which occurs at a second paper path by a jam detector;

displaying the first jam removal guidance for a first jam in case of detecting the first jam;

detecting whether a second door which covering and uncovering the second paper path, is open or closed;

switching to display a second jam removal guidance from the first jam removal guidance on a display in case of detecting the second door open.

16. The method of displaying jam removal guidance according to claim 15, wherein the first jam removal guidance and the second jam removal guidance include at least one of a sound, a character, and either of a still image and a moving image.

17. The method of displaying jam removal guidance according to claim 15, wherein the first jam removal guidance and the second jam removal guidance include at least one of character and graphic.

18. The method of displaying jam removal guidance according to claim 15, further comprising:

obtaining an information of a location where a jam occurs detected by the jam detector; and displaying a location where the jam occurred based on the obtained information.

19. The method of displaying jam removal guidance according to claim 18, wherein the jam occurrence location displaying step includes:

updating displayed contents of the location where at least one open door is closed.

20. The method of displaying jam removal guidance according to claim 18, wherein the jam occurrence location displaying step includes:

updating displayed contents of the location where the jam occurs based on the obtained information when the jam detector detects the jam removal.

* * * * *